US008278842B2

(12) United States Patent
Lee et al.

(10) Patent No.: US 8,278,842 B2
(45) Date of Patent: Oct. 2, 2012

(54) LAMP SET

(75) Inventors: Chia-Ying Lee, Taipei (TW); Jian-Ming Peng, Taipei (TW)

(73) Assignee: Pegatron Corporation, Taipei (TW)

( * ) Notice: Subject to any disclaimer, the term of this patent is extended or adjusted under 35 U.S.C. 154(b) by 362 days.

(21) Appl. No.: 12/564,455

(22) Filed: Sep. 22, 2009

(65) Prior Publication Data

US 2010/0079089 A1 Apr. 1, 2010

(30) Foreign Application Priority Data

Sep. 26, 2008 (TW) ..... 97137204 A

(51) Int. Cl.
*H05B 41/36* (2006.01)

(52) U.S. Cl. ..... 315/307; 315/291; 315/218

(58) Field of Classification Search ..... 315/129, 315/134, 136, 218, 149, 150, 158, 291, 297, 315/307, 308
See application file for complete search history.

(56) References Cited

U.S. PATENT DOCUMENTS

| | | | | |
|---|---|---|---|---|
| 6,280,344 | B1 | 8/2001 | Robb | |
| 2008/0197782 | A1* | 8/2008 | Frumau | 315/151 |
| 2008/0265802 | A1* | 10/2008 | Van de Sluis et al. | 315/297 |

FOREIGN PATENT DOCUMENTS

| | | | |
|---|---|---|---|
| CN | 1571114 | A | 1/2005 |
| CN | 201083345 | Y | 7/2008 |
| TW | I264247 | B | 9/2005 |

* cited by examiner

*Primary Examiner* — Douglas W Owens
*Assistant Examiner* — Jianzi Chen
(74) *Attorney, Agent, or Firm* — Muncy, Geissler, Olds & Lowe, PLLC

(57) ABSTRACT

A lamp set includes a control device and a first lighting device. The control device includes an energy-generating unit for providing an energy distribution. The first lighting device includes a pre-processing unit, a first lighting element, and a controller. The controller is coupled to the pre-processing unit and the first lighting element. The pre-processing unit is used to sense the energy distribution or to receive information included in the energy distribution thus to allow the controller to control luminance of the first lighting element according to the energy distribution.

5 Claims, 4 Drawing Sheets

LAMP SET

CROSS REFERENCE TO RELATED APPLICATIONS

This Non-provisional application claims priority under 35 U.S.C. §119(a) on Patent Application No(s). 097137204 filed in Taiwan, Republic of China on Sep. 26, 2008, the entire contents of which are hereby incorporated by reference.

BACKGROUND OF THE INVENTION

1. Field of Invention

The invention relates to a lamp set and, more particularly, to a lamp set including a plurality of individual lamps.

2. Related Art

A lamp plays an important role in people's daily life. The lamp can be used for illumination and decoration as well. However, the conventional lamp is controlled to be turned on or off by a specific switch. In addition, the conventional lamp generally has a single and fixed form, thus failing to interest users in operation.

At present, the lamp emits only one color light. Although a lamp bulb may be multicolored, the color of the lamp bulb is constant. Thus, the color of the light emitted by each lamp bulb is constant, failing to satisfy people's visual demand.

To sum up, the conventional lamp fails to interest the users in operation and fails to satisfy people' demand for the color of the light as well.

SUMMARY OF THE INVENTION

According to one aspect of the invention, the invention provides a lamp set including a control device and a first lighting device. The control device includes an energy-generating unit for providing an energy distribution. The first lighting device includes a pre-processing unit, a first lighting element, and a controller. The controller is coupled to the pre-processing unit and the first lighting element. The pre-processing unit is used to sense the energy distribution or to receive information included in the energy distribution to allow the controller to control luminance of the first lighting element according to the energy distribution.

To sum up, in the invention, the control device of the lamp set can provide an energy distribution. The first lighting device can automatically control itself to light or not to light by sensing the energy distribution or receiving the information included in the energy distribution. Furthermore, according to the sensed energy distribution, the first lighting device can control the luminance and the color of the light emitted by itself.

These and other features, aspects, and advantages of the present invention will become better understood with regard to the following description, appended claims, and accompanying drawings.

DETAILED DESCRIPTION OF THE INVENTION

Figure 1:
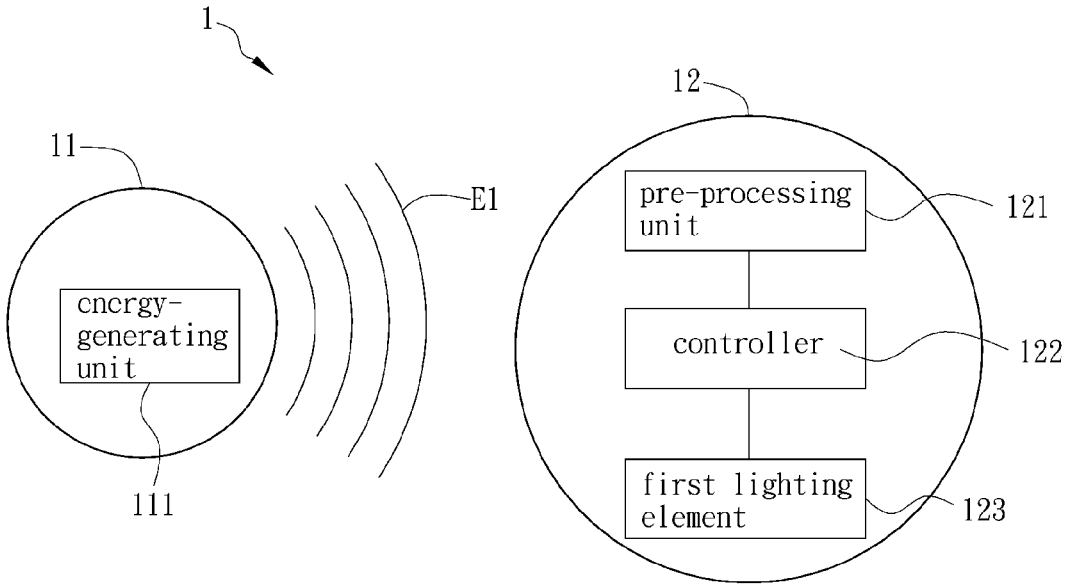
FIG. 1 is a schematic diagram of a lamp set according to a first preferred embodiment of the invention.

FIG. 1 is a schematic diagram of a lamp set according to a first preferred embodiment of the invention. In FIG. 1, a lamp set 1 includes a control device 11 and a first lighting device 12.

The control device 11 includes an energy-generating unit 111 for providing an energy distribution E1. The first lighting device 12 includes a pre-processing unit 121, a controller 122, and a first lighting element 123. The controller 122 is coupled to the pre-processing unit 121 and the first lighting element 123, respectively.

In the embodiment, the energy-generating unit 111 is a magnet, and the energy distribution E1 is a magnetic field. The pre-processing unit 121 is a Hall element. The first lighting element 123 is a light-emitting diode (LED) lamp. In the other embodiments, the energy-generating unit 111 may be an ultrasonic generator, an electromagnetic wave generator, or any other devices capable of building the energy distribution. In the other embodiments, the pre-processing unit 121 may be an ultrasonic receiver, an electromagnetic wave receiver, or any other devices capable of sensing or receiving the energy distribution. The invention does not limit the types of the energy-generating unit 111, the pre-processing unit 121, and the first lighting element 123.

The Hall element is a magnet sensing element for magneto-electric transduction according to the Hall effect. The Hall effect is the physical phenomenon that a transversal potential difference is produced when a magnetic field is applied on charge-carrying particles in a charge-carrying metallic conductor or semiconductor.

In the embodiment, the energy-generating unit 111 (the magnet) is used to provide a magnetic field E1. When the first lighting device 12 approaches the control device 11 and enters into the magnetic field E1 provided by the energy-generating unit 111, the pre-processing unit 121 (the Hall element) of the first lighting device 12 can sense the magnetic field E1 and transduce the magnetic field E1 into a voltage (or current) signal. The controller 122 analyzes and processes the voltage (or current) signal to control whether the first lighting element 123 lights and to control luminance of the first lighting element 123. In the embodiment, the color of the light emitted by the first lighting element 123 can be preset.

When the first lighting device 12 is near the control device 11, the strength of the magnetic field E1 sensed by the pre-processing unit 121 (the Hall element) is stronger. At that moment, the output voltage (or current) signal of the pre-processing unit 121 (the Hall element) also correspondingly increases. According to the stronger voltage (or current) signal, the controller 122 controls the first lighting element 123 to emit the brighter light.

When the first lighting device 12 is far from the control device 11, the strength of the magnetic field E1 sensed by the pre-processing unit 121 (the Hall element) is weaker. At that moment, the output voltage (or current) signal of the pre-processing unit 121 (the Hall element) also correspondingly decreases. According to the weaker voltage (or current) signal, the controller 122 controls the first lighting element 123 to emit the darker light.

Furthermore, when the first lighting device 12 is farther from the control device 11, and it moves away from the magnetic field E1 provided by the energy-generating unit 111, the pre-processing unit 121 (the Hall element) cannot sense the magnetic field E1. At that moment, the pre-processing unit 121 (the Hall element) does not provide the output voltage (or current) signal, and the controller 122 controls the first lighting element 123 not to light.

In the embodiment, the control device 11 can control the luminance of the LED lamp 123 of the first lighting device 12 via the magnetic field generated by the energy-generating unit 111 (the magnet). In the other embodiments, the control device 11 may also control the luminance of the first lighting element 123 of the first lighting device 12 via the energy distribution generated by an ultrasonic generator or an electromagnetic wave generator.

Figure 2:
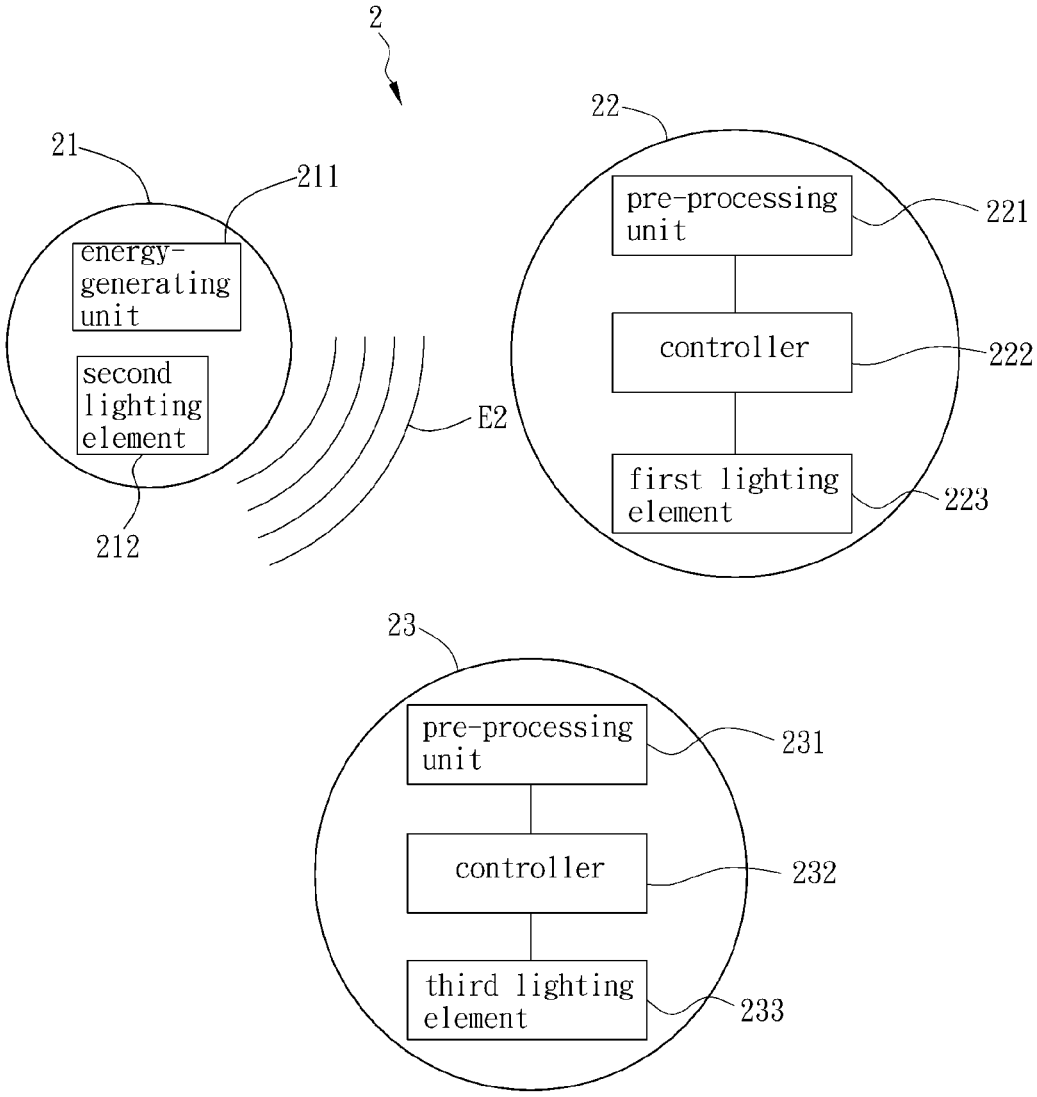
FIG. 2 is a schematic diagram of a lamp set according to a second preferred embodiment of the invention.
Figure 3:
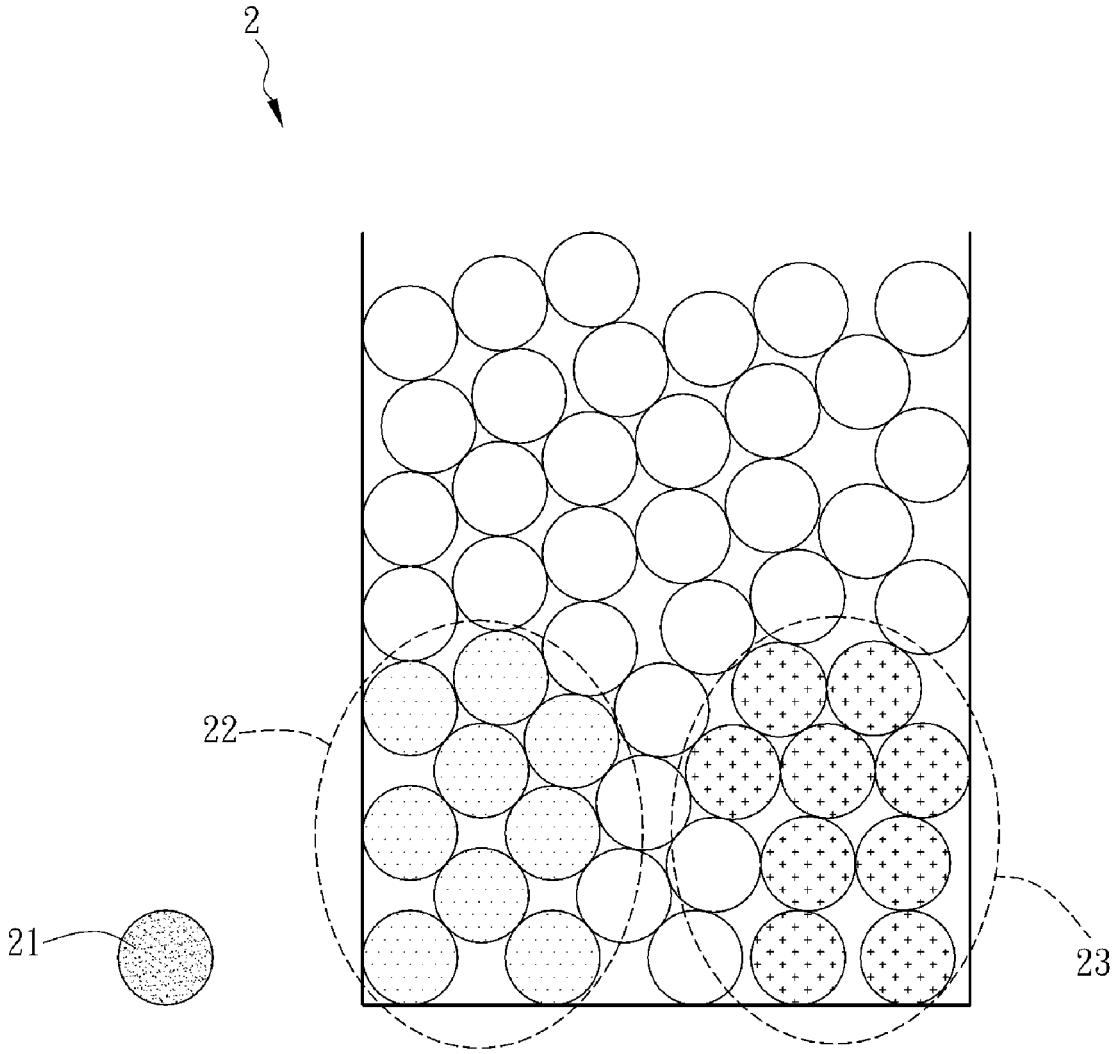
FIG. 3 is a schematic diagram showing the whole of a lamp set according to the second preferred embodiment of the invention.

FIG. 2 is a schematic diagram of a lamp set according to a second preferred embodiment of the invention. FIG. 3 is a schematic diagram showing the whole of a lamp set according to the second preferred embodiment of the invention. The embodiment is described hereinbelow. Please refer to FIG. 2 and FIG. 3.

A lamp set 2 includes a control device 21 and a plurality of lighting devices 22 and 23. In FIG. 2, only a first lighting device 22 and a third lighting device 23 are shown.

The control device 21 includes an energy-generating unit 211 for providing an energy distribution E2 and a second lighting element 212. The first lighting device 22 includes a pre-processing unit 221, a controller 222, and a first lighting element 223. The third lighting device 23 includes a pre-processing unit 231, a controller 232, and a third lighting element 233.

The controller 222 is coupled to the pre-processing unit 221 and the first lighting element 223, respectively. The controller 232 is coupled to the pre-processing unit 231 and the third lighting element 233, respectively.

In the embodiment, the energy-generating unit 211 is a radio-frequency (RF) transmitting element, and the energy distribution E2 is a RF signal. The pre-processing unit 221 and the pre-processing unit 231 are a RF receiving element, respectively. In the other embodiments, the energy-generating unit 211 may be an ultrasonic generator, an electromagnetic wave generator, or any other devices capable of building the energy distribution. In the other embodiments, the pre-processing units 221 and 231 may be an ultrasonic receiver, an electromagnetic wave receiver, or any other devices capable of sensing or receiving the energy distribution, respectively. The invention does not limit the types of the energy-generating unit 211, the pre-processing unit 221, and the first lighting element 223.

In the embodiment, the number of the energy-generating unit 211 (the RF transmitting element) is not limited, and the energy-generating unit 211 (the RF transmitting element) is used to provide a RF signal including color information. When the first lighting device 22 and the third lighting device 23 approach the control device 21 and then receive the RF signal, the pre-processing units 221 and 231 (the RF transmitting elements) of the first lighting device 22 and the third lighting device 23 sense and receive the RF signal including the color information, respectively. Then the pre-processing units 221 and 231 convert the RF signal to a voltage (or current) signal, respectively. The controllers 222 and 232 analyze and process the voltage (or current) signal to control whether the first lighting element 223 and the third lighting element 233 light, respectively. In addition, according to the color information in the RF signal, the controllers 222 and 232 can control the light colors of the first lighting element 223 and the third lighting element 233. The color information can be processed in an encoded mode, and the controllers 222 and 223 can decode the color information.

For example, the first lighting element 223 and the third lighting element 233 may further include a plurality of sets of LED lamps. Each set of the LED lamps emits light of one different color such as red, yellow, and green. In FIG. 3, the LED lamps emitting the light of the same color are marked with the same points, and the LED lamps emitting the light of the same color are shown with the same marks. The points of the control device 21, the first lighting device 22, and the third lighting device 23 indicate different light colors, respectively. According to the aforementioned color information in the RF signal, the controllers 222 and 223 can control one set of the LED lamps of the first lighting element 223 and the third lighting element 233 to emit the light of the color corresponding to the color information.

For example, according to the color information received by the pre-processing unit 221, the controller 222 controls one set of the LED lamps of the first lighting element 223 to emit blue light. According to the color information received by the pre-processing unit 231, the controller 232 controls one set of the LED lamps of the third lighting element 233 to emit red light.

In addition, in the embodiment, the relation of the light colors of the first lighting element 223, the second lighting element 212, and the third lighting element 233 can be controlled in other modes. For example, the light color of the first lighting element 223 is a first predetermined color, the light color of the second light element 212 is a second predetermined color, and the light color of the third lighting element 233 is a third predetermined color. The first predetermined color, the second predetermined color, and the third predetermined color can be the same as each other, and they can also be different from each other. The invention is not limited thereto.

Figure 4:
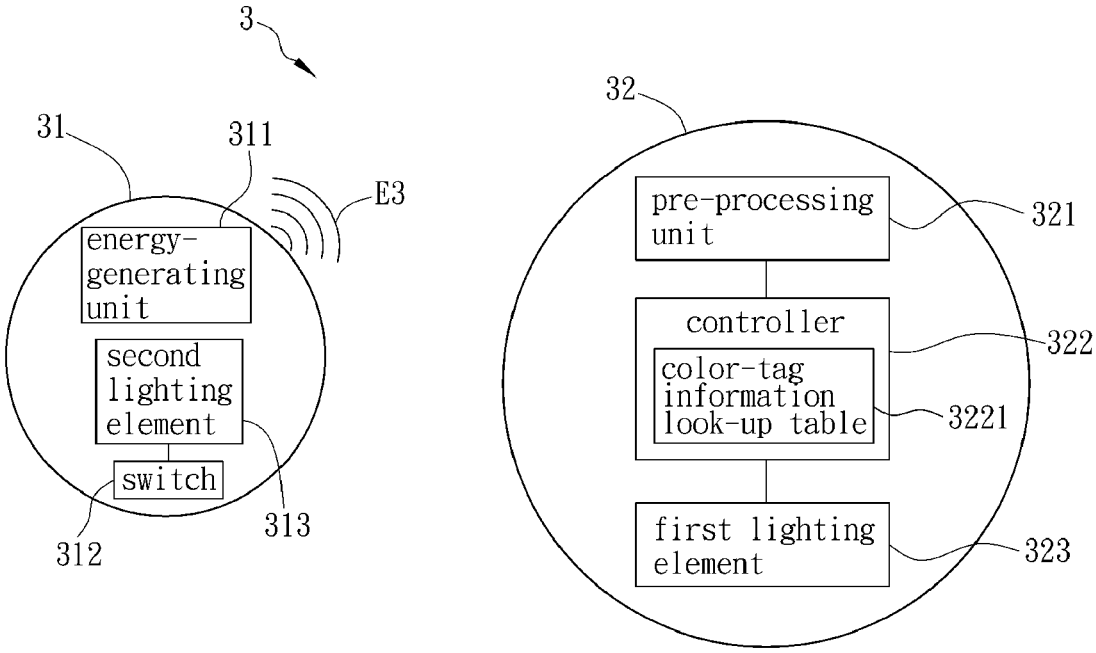
FIG. 4 is a schematic diagram of a lamp set according to a third preferred embodiment of the invention.

FIG. 4 is a schematic diagram of a lamp set according to a third preferred embodiment of the invention. In the embodiment, a lamp set 3 includes a control device 31 and a first lighting device 32.

The control device 31 includes an energy-generating unit 311 for providing an energy distribution E3, a switch 312, and a second lighting element 313.

The first lighting device 32 includes a pre-processing unit 321, a controller 322, and a first lighting element 323. The controller 322 is coupled to the pre-processing unit 321 and the first lighting element 323.

In the embodiment, the energy-generating unit 311 is a wireless radio-frequency identification (RFID) tag capable of providing an electromagnetic wave which can have tag information. The pre-processing unit 321 is a wireless RFID reader. The first lighting element 323 includes a first set of LED lamps, a second set of LED lamps, and a third set of LED lamps (not shown), and the light color of each set of the LED lamps is different.

The basic operation procedure of the wireless RFID system is described as follows. The wireless RFID reader transmits a RF signal with a certain frequency via a transmitting antenna. When the wireless RFID tag enters into a working area of the transmitting antenna, the wireless RFID tag generates an induction electric current, and it obtains energy thus to be started. The wireless RFID tag transmits information such as an encoding of itself via a built-in transmitting antenna. The wireless RFID reader demodulates and decodes the received signal, and then it transmits the signal to perform related processing thus to transmit a control signal.

In the embodiment, an identification code of the wireless RFID tag is 1000. In the embodiment, the controller 322 includes a color-tag information look-up table 3221 having a plurality of comparison groups. For example, when the identification code is 1000, the first set of the LED lamps lights. When the identification code is 1001, the second set of the LED lamps lights. When the identification code is 1011, the third set of the LED lamps lights.

When the control device 31 approaches the first lighting device 32, the energy-generating unit (the wireless RFID tag) 311 enters into the working area of the transmitting antenna of the pre-processing unit (the wireless RFID reader) 321. The energy-generating unit (the wireless RFID tag) 311 transmits the tag information 1000 via the energy distribution E3.

After the pre-processing unit 321 receives the tag information of the identification code 1000, it transmits the information to the controller 322. The controller 322 looks up the table, and according to the color-tag information look-up table, it controls the first set of the LED lamps of the first lighting element 323 to light. In the embodiment, the light color of the first set of the LED lamps is the same as that of the second lighting element.

In the embodiment, if the first lighting element 323 is to emit the light of other colors, the control device 31 having different tag information can be used to control the color of the light. In the other embodiments, the controller 322 includes a counter (not shown) for accumulating the tag information to allow the first lighting element 323 to emit the light of different colors. Furthermore, after the controller 322 receives the tag information of the identification code 1000 for the first time, the first set of the LED lamps of the first lighting element 323 lights. Then a counting value is added with "1". After the controller 322 receives the tag information of the identification code 1000 for the second time, the controller 322 can perform related processing on the counting value and the tag information (such as accumulation), and the processing result may be 1001. Thus, according to the processing result, the controller 322 can control the second set of the LED lamps of the first lighting element 323 to light.

In the embodiment, the switch 312 of the control device 31 is used to control operation of the second lighting element 313.

To sum up, according to the embodiment, the lamp set includes the control device and the lighting device, and the control device and the lighting device are an individual object, respectively. The control device can control whether the lighting device lights or the light color of the lighting device in a non-direct contact mode. Thereby, the lamp set providing the new operation mode for the users is obtained and can satisfy users' demand for different kinds of the light colors.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A lamp set comprising:

a control device including a magnet for providing an magnetic field; and a first lighting device including a magnet sensing unit, a first lighting element, and a controller, wherein the controller is coupled to the magnet sensing unit and the first lighting element, and the magnet sensing unit is used to sense an intensity of the magnetic field to allow the controller to control luminance of the first lighting element according to the intensity of the magnetic field representing the distance between the control device and the first lighting device.

2. The lamp set according to claim 1, wherein the control device further comprises a second lighting element and a switch, and the switch is coupled to the second lighting element for controlling operation of the second lighting element.

3. The lamp set according to claim 2, wherein a light color of the first lighting element is a first predetermined color, and a light color of the second lighting element is a second predetermined color.

4. The lamp set according to claim 3, wherein the first predetermined color is the same as the second predetermined color.

5. The lamp set according to claim 3, wherein the first predetermined color is different from the second predetermined color.

* * * * *